United States Patent [19]

Kartman

[11] 4,090,671

[45] May 23, 1978

[54] TUBE MILL AND METHOD FOR GRINDING CEMENT CLINKER

[75] Inventor: Helge Carl Christian Kartman, Copenhagen Valby, Denmark

[73] Assignee: F. L. Smidth & Co., Cresskill, N.J.

[21] Appl. No.: 754,963

[22] Filed: Dec. 28, 1976

[30] Foreign Application Priority Data

Dec. 29, 1975 United Kingdom ..... 52974/75

[51] Int. Cl.[2] ..... B02C 17/06

[52] U.S. Cl. ..... 241/29; 241/30; 241/70; 241/79.3

[58] Field of Search ..... 241/18, 23, 29, 30, 241/49, 51, 54, 57, 70, 71, 72, 78, 79.3

[56] References Cited

U.S. PATENT DOCUMENTS

| | | | |
|---|---|---|---|
| 1,246,775 | 11/1917 | Mushett | 241/70 |
| 1,504,777 | 8/1924 | Newhouse | 241/72 |
| 1,620,982 | 3/1927 | Newhouse | 241/54 |
| 3,013,734 | 12/1961 | Hirschmann | 241/17 |
| 3,289,950 | 12/1966 | Helming et al. | 241/18 |
| 3,877,650 | 4/1975 | Cornford | 241/71 |

FOREIGN PATENT DOCUMENTS

| | | | |
|---|---|---|---|
| 680,969 | 9/1969 | Germany | 241/54 |

*Primary Examiner*—Granville Y. Custer, Jr.
*Attorney, Agent, or Firm*—Pennie & Edmonds

[57] ABSTRACT

A multi-compartment tube mill is disclosed for the grinding of coarse material such as cement clinker in which the tube mill is divided into at least two mill sections each of which includes at least one grinding chamber. An inlet is provided at one end of the tube mill for the coarse material and for ventilating air or gas to ventilate the tube mill and for heat exchange with the material. An outlet is provided at the opposite end of the tube mill for the ground product. Disposed between the two mill sections is a composite diaphragm which defines a separation zone therebetween for removing humidity from the first mill section, and for introducing fresh ventilating air or gas into the second mill section. A method is disclosed for grinding coarse material in the inventive tube mill in which atmospheric conditions are controlled from the inlet to the outlet of the mill.

24 Claims, 5 Drawing Figures

TUBE MILL AND METHOD FOR GRINDING CEMENT CLINKER

BACKGROUND OF THE INVENTION

1. Field of the Invention

The present invention relates to a multi-compartment tube mill for the grinding of coarse material.

2. Description of the Prior Art

It is well known in the prior art to use multi-compartment mills for grinding coarse material and for effecting an exchange of heat with air or gas. Such mills have generally included an inlet at one end of the material to be ground and for entry of the air or gas, and an outlet at the other end for exiting the ground product and the air or gas which has participated in a heat exchange process in the mill. At the same time the air or gas usually serves as a transport medium for carrying the ground product out of the mill to a separator. The mills generally include a separator which may be in the form of a common cyclone or an air classifier from which the oversize material is usually returned to the mill for further grinding.

It is also known to use multi-compartment mills having a central discharge chamber from which material is discharged together with the air or the gas, through peripheral openings in the mill shell; whereas, depending on the process performed in the mill, raw material and/or coarse material is fed to both ends of the mill together with air or gas.

In multi-compartment mills of the last mentioned type, it is also known to process material for grinding and drying by directing hot gas together with moist material to one end of the mill and by introducing additional hot gas into the central discharge chamber for passing countercurrently to the material fed to the inlet end of the mill which is flowing from that feed end to the central discharge chamber.

In these known constructions it is difficult to achieve the desired heat exchange, especially in mills adapted for large production. Such large production mills generally combine the cross-section of the mill with a preferred low velocity of the air or gas to restrict the amount of air or gas passing therethrough. Further, the constructions having a central outlet generally involve complicated installations with feed arrangements at both ends of the mills and conveyors for transporting and distributing the ground and the classified material.

The known mills of this type are particularly not suitable for carrying out a controlled grinding and heat exchange process especially when grinding heat-sensitive material such as cement clinker. I have invented an improved multi-compartment tube mill in which these disadvantages are avoided.

SUMMARY OF THE INVENTION

The invention relates to a multi-compartment tube mill for grinding coarse material. The mill — which is divided into at least two mill sections — comprises a first mill section including at least one grinding chamber, and a second mill section adjacent the first mill section and including at least one grinding chamber therein. The mill further comprises inlet means communicating with the first mill section for feeding coarse material and gas or ventilating air thereto, and outlet means communicating with the second mill section of the tube mill for discharging ground material from the mill. A composite diaphragm is disposed between the first and second mill sections and defines a heat exchange zone therebetween, the composite diaphragm having at least a peripheral portion which defines at least one opening for the discharge of waste gas from the first mill section of the tube mill and at least a second peripheral portion which defines at least one opening for directing intake gas to the second mill section of the tube mill. The mill further comprises means to transfer material from the first mill section to the second mill section.

Thus, the mill constructed in accordance with the invention includes a unique composite diaphragm which defines a separation zone between the mill sections. In the preferred form, a first set of peripheral openings is provided in the mill shell for the withdrawal of the air or gas from the first section of the mill, and a second set of peripheral openings is provided through which fresh air or gas may be passed to the second section of the mill. The composite diaphragm includes separate passages for transferring the material from the first section of the mill to the second section.

The air or gas fed to the first section of the mill together with the material to be ground is arranged in this section to produce a heat exchange process for establishing the desired conditions. The air or gas may serve to heat, dry or cool the material, the mill proper and any grinding bodies. Thus, the air or gas ventilates the mill and also removes humidity so as to establish a preferred atmosphere inside the mill.

However, the increasing sizes of such mills usually necessitate the passing of increasing amounts of air or gas through the mill in order to provide the necessary heating or cooling. Also, by replacing the air or gas passed through the first section of the mill by fresh air or gas passed through the second section of the mill, the atmosphere inside the mill can be controlled from its inlet to its outlet, and this feature is considered to be advantageous.

The desired conditions can thus also be readily obtained in the second section of the mill which is fed with fresh air or gas through the second peripheral openings in the central part of the mill. Obviously, replacing the used air or gas with fresh air or gas provides an immense advantage, since, irrespective of the cross-sectional area of the passage through the mill, the amount of air or gas that can be passed through the mill in this manner is approximately doubled.

Preferably, the separate passages for the material through the composite diaphragm are constituted by tubes of spiral or helical form capable of containing an amount of material acting as airtight sluices and of transporting the material upon rotation of the mill.

The separate passages through which the material is conveyed from the first section of the mill to the second section are considered to be advantageous features since they prevent gas from passing together with the material into the second section. As a result of the containment of material in these passages, the material forms a sealing trap and does not affect the continuous conveyance of the material through the spiral or helical tubes by the rotation of the mill. The spiral or helical tubes are positioned in a substantially radial plane and collect the material from the first section of the mill or are fed with material by means of lifters or scoops.

Advantageously, the composite diaphragm is arranged with means for controlling the charge in the first section by providing the composite diaphragm with a first compartment between an upstream sieving diaphragm and a downstream dam ring with or without lifters. The ends of the lifters are spaced from the interior peripheral wall of the mill and the first compartment, which forms part of the composite diaphragm, serves to receive the ground material and to establish a reservoir of ground material in the mill. This reservoir of ground material determines the level of material in the first section of the mill as material in the first compartment is discharged. The ground material is discharged either by overflow through the dam ring, or by arranging the lifters so that they determine the level of material in the compartment.

The central part of the mill with the composite diaphragm may be surrounded in a known manner by a stationary casing covering the openings in the shell. The stationary casing will have a discharge opening for the air or gas from the first section of the mill and an intake for the fresh air or gas. The mill may then be equipped with spiral tubes for collecting material from the bottom of the casing and for feeding such material into the second section of the mill.

Inevitably, some material is carried by the air or gas through the composite diaphragm to the casing. The spiral tubes mounted on the mill scoop this material up during the rotation of the mill and convey the material into the second section of the mill. The helical or spiral form of the tubes ensures that the tubes always contain material for sealing the passages against penetration of the air or gas.

The invention also relates to a method of grinding cement clinker to cement in a mill constructed in accordance with the main feature of the invention. The mill is ventilated by air for removing humidity and for cooling to achieve desired temperature conditions inside the mill during the grinding process, the ventilating air being admitted to the inlet end of the mill and, after passing through one or more grinding chambers forming the first mill section, being substituted by fresh air passed in through the second set of peripheral openings and through the last grinding chamber or chambers forming the second mill section. This method permits the feeding of fairly hot clinker to the mill and also permits the humidity in the first section of the mill to rise to a relatively high level because the air is substituted by fresh air for the necessary cooling in the second section of the mill and for removal of the humidity from the second section of the mill.

Water may be injected into one or both sections of the mill to provide additional cooling of the material. For this arrangement, the humidity from the injected water is easily removed by the ventilating air. The injection of water renders it possible to control the temperature conditions within narrow limits by controlling the amounts of water injected for removal of the heat generated by the grinding of the material.

Circuit grinding may be established by recirculating at least some of the material through at least the second section of the mill.

The oversize from a classifier may thus — in a circuit grinding — be fed to the casing surrounding the central part of the mill and hence to the second section of the mill to by-pass the first section of the mill.

BRIEF DESCRIPTION OF THE DRAWINGS

Preferred embodiments of the invention are described hereinbelow with reference to the drawings wherein.

DETAILED DESCRIPTION OF THE PREFERRED EMOBIDIMENTS

Figure 1:
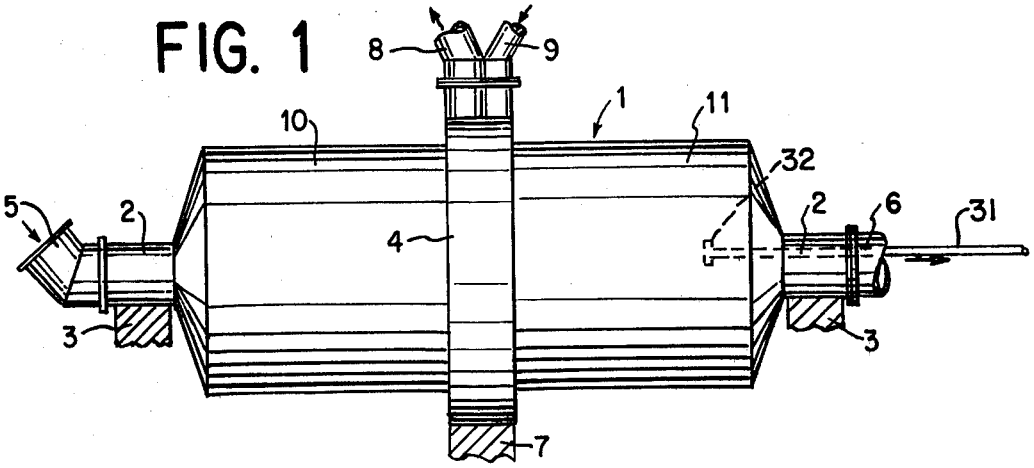
FIG. 1 is a side elevational view of a tube mill constructed according to the invention.

Referring to FIG. 1, there is shown a rotatable tube mill having a tubular mill shell 1, two trunnion bearings 2, supported by foundations 3, and a stationary casing 4 surrounding a central portion of the mill shell 1. One end of the tube mill has an inlet 5 for feeding coarse material and gas or air through the hollow trunnion 2 that communicates therewith. The other end of the tube mill has an outlet 6 for the discharge of ground material through the other hollow trunnion 2. The stationary casing 4, supported by the foundation 7, is provided with an outlet 8 for the discharge of waste air or gas and an inlet 9 for the reception of fresh air or gas.

The tube mill is divided into two sections 10 and 11 which may both comprise one or more grinding compartments. The two sections 10 and 11 are separated as shown in detail in FIG. 2 by a composite diaphragm 12. The composite diaphragm 12 comprises three adjacent chambers 17, 18 and 19 whose boundaries are defined respectively, by a sieving diaphragm 13, dam ring 14, a solid wall 15 and a dam ring 16. Chamber 17, which is bounded by the sieving diaphragm 13 and the dam ring 14, is provided with built-in lifters 20 which communicate, through an annular slit 21 with the central chamber 18 which is bounded by the dam ring 14 and the solid wall 15.

The central chamber 18 communicates with the first mill section 10 through diaphragm 13 and a frustoconical sieve drum 13*a* and through a central opening in the dam ring 14. The chamber 18 opens through the mill shell to the stationary casing 4 by means of openings 22 which communicate with the outlet 8. The chamber 18 is further provided with two spiral tubes 23 which extend from the outside of the tube mill shell through the solid wall 15, into the neighboring chamber 19, and through a central opening in the dam ring 16 into the second mill section 11.

The chamber 19 has air or gas inlet openings 24 in the mill shell 1. The casing 4 is divided by an annular plate 25 so that the inlet openings 24 communicate with a separate annular chamber 26 of the casing 4 which permits the annular chamber 26 to communicate with the inlet opening 9 for the intake of fresh air or gas.

Figure 4:
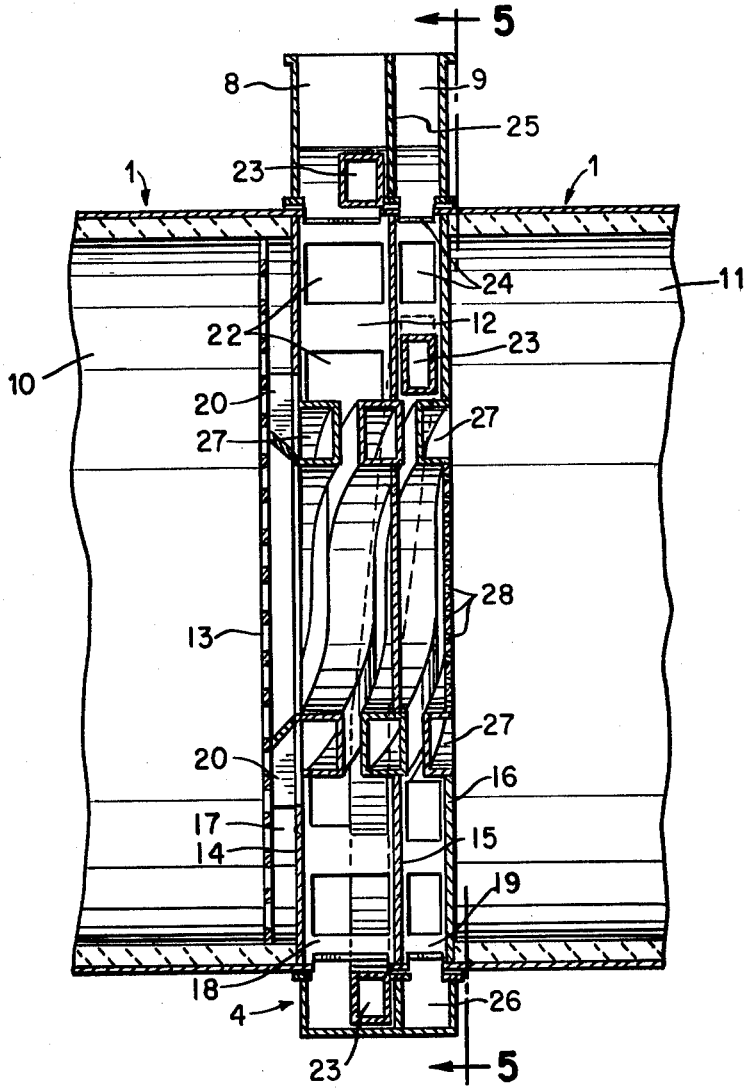
FIG. 4 is a cross sectional view of an alternate preferred embodiment of the composite diagphragm of the invention.
Figure 5:
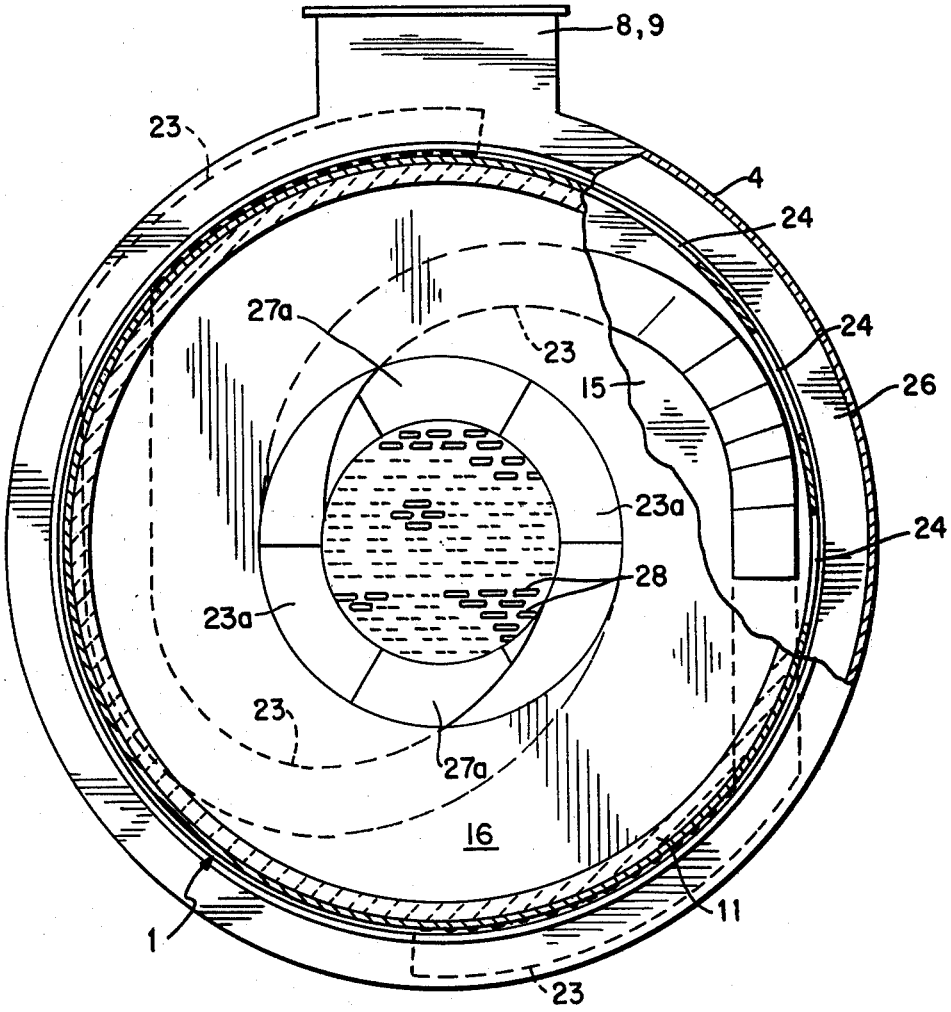
FIG. 5 is a cross sectional view along lines 5—5 of FIG. 4.

In the modified composite diaphragm, as illustrated in FIGS. 4 and 5, the frustoconical sieve drum is replaced by two helical tubes 27 which are mounted to transfer material from the lifters 20 through the solid wall 15 and into the second section 11 of the tube mill. The central opening in the dam ring 16 is provided with a screen 28 to prevent material from being thrown back into the chamber 19 of the composite diaphragm 12.

Figure 2:
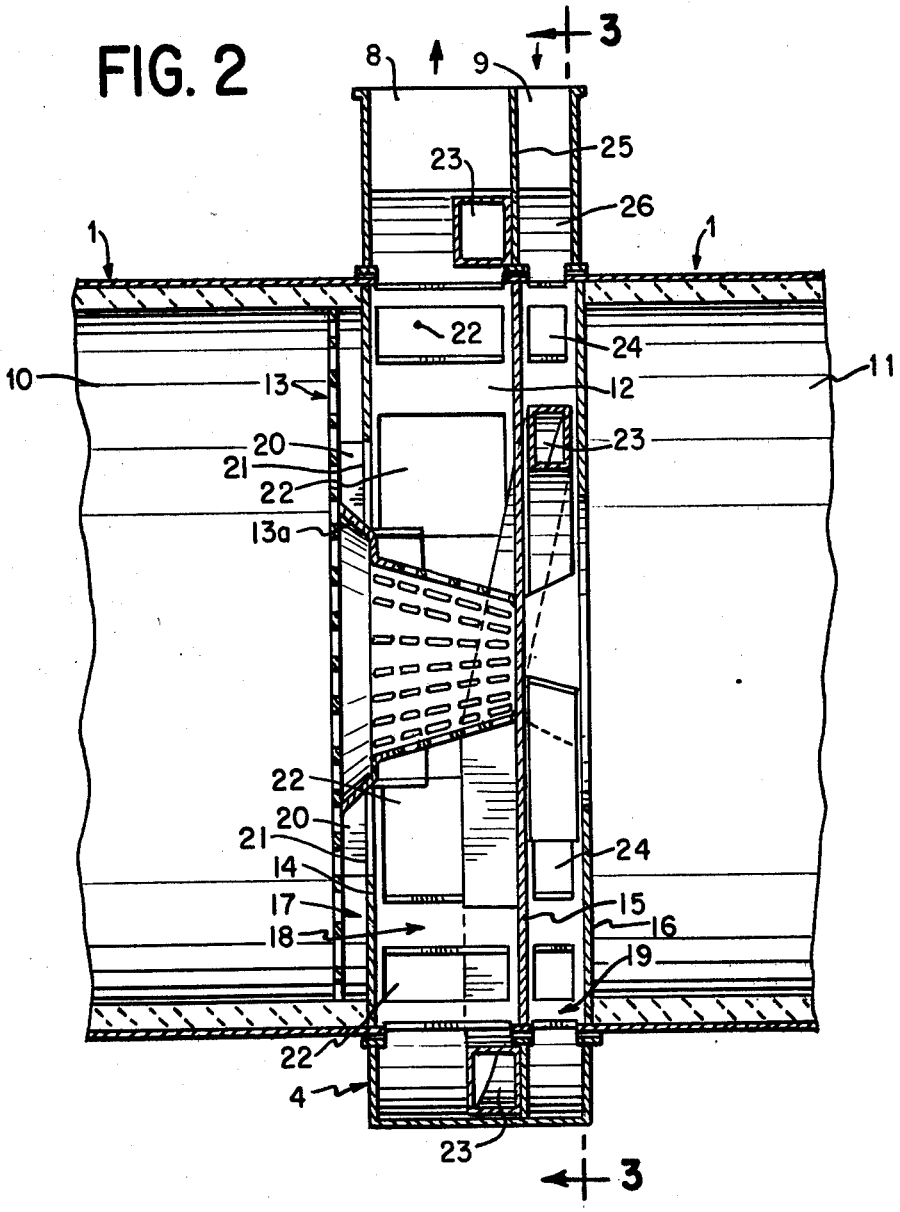
FIG. 2 is a cross sectional side view of a preferred embodiment of the composite diaphragm of the tube mill of FIG. 1.
Figure 3:
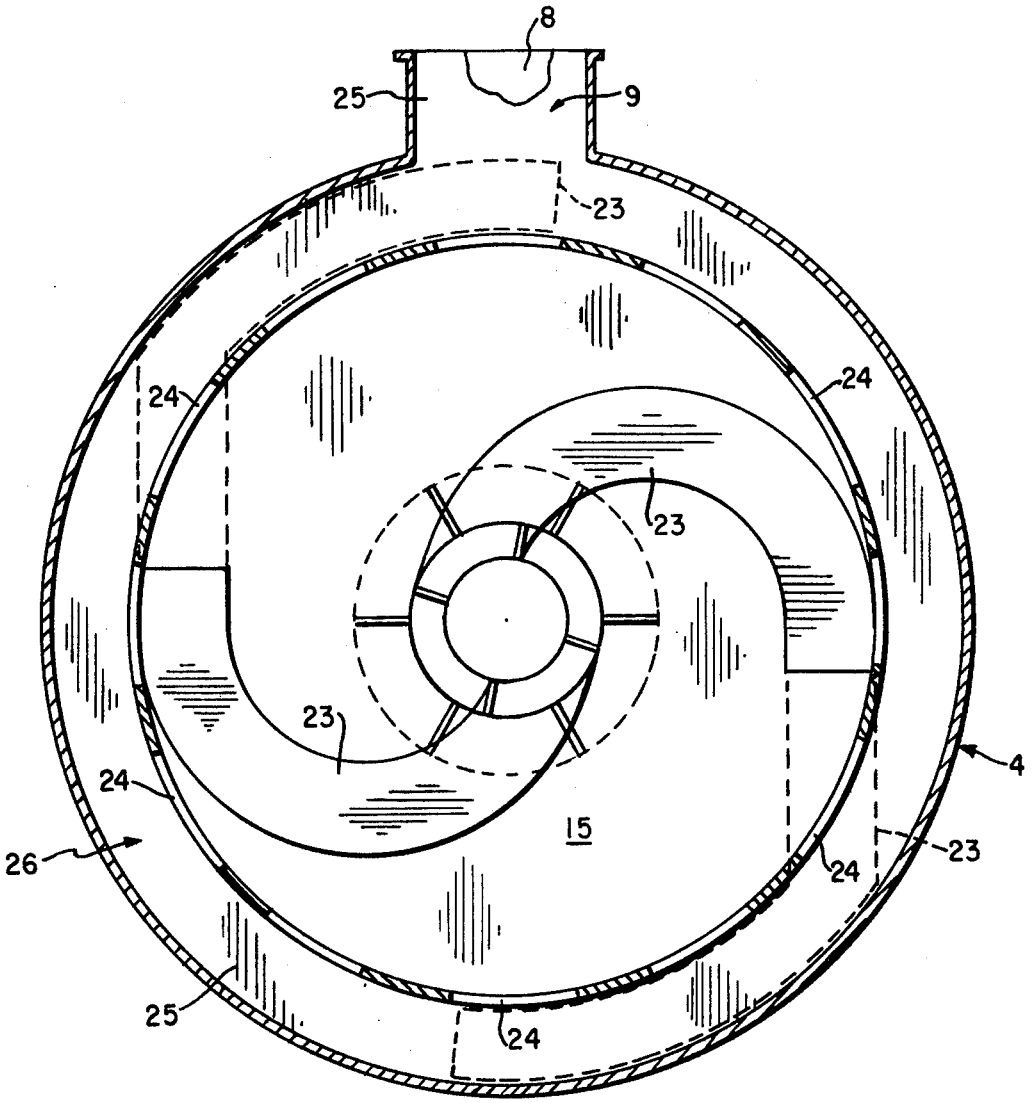
FIG. 3 is a cross sectional view taken along lines 3—3 of FIG. 2.

During operation of the modification of FIGS. 2 and 3, material ground in the first section 10 passes through the sieving diaphragm 13 into the chamber 17 of the composite diaphragm. A quantity of ground material is always present in this chamber because the length of the lifters 20 is exceeded by the radius of the chamber and the lifters 20 do not extend to the periphery of the chamber. Chamber 17, therefore, acts as a reservoir for ground material which may pass backwards to the first section of the mill to ensure that it contains a preferred charge of ground material. The material in the chamber 17 is charged into the chamber 18 through the slit 21 and passes from the chamber 18 through openings 22 to the casing 4 and collects in the bottom of the casing 4. The material is scooped up by the spiral tubes 23 and conveyed through the tubes and discharged into the second section of the tube mill through the central opening in the dam ring 16.

The waste gas passes from the first section of the mill through the frustoconical sieve drum 13*a* into the chamber 18 and exits through the openings 22 provided in the mill shell. The waste gas is prevented from passing into the second section 11 of the mill by the solid wall 15 and passage of the waste gas through the spiral tubes 23 is blocked by the material conveyed therein. Fresh air or gas is received into the chamber 19 through the openings 24. The air or gas passes between the two spiral tubes 23 and through the central opening in the dam ring 16 into the section 11 of the tube mill. Thus, an exchange of the air or gas passed through the mill is carried out in the manner described.

In the modified construction illustrated in FIG. 4, the gas passages are similar to those shown in FIG. 2. However, the material transferred by the lifters 20 is directed into two helical tubes 27 which convey the material through the composite diaphragm 12 into the second section 11 of the tube mill. In this modification, only a minor quantity of material collects in the bottom of the casing 4. From there it is conveyed into the second section 11 of the tube mill by means of spiral tubes 23. The two sets of conveyor tubes 23 and 27 discharge through partially annular openings 23*a*, 27*a*, respectively, in the dam ring 16. The central opening of the dam ring 16 is covered by the screen 28 which allows the fresh air or gas to pass into the second section of the mill and prevents material from returning into the chamber 19.

The mill as described hereinabove is especially applicable in a process for grinding cement clinker to cement. In modern cement plants the clinker fed to the cement mill is often hot since it is conveyed substantially directly to the mill so as to limit the intermediate storage and handling of the clinker. However, the feed of hot clinker necessitates improved cooling of the mill in order to control the temperature of the clinker and the quantity of heat generated during the grinding process. In conventional cement grinding processes it is usual to inject water into the tube mill for use as a cooling agent so as to remove large amounts of heat. See, for example, FIG. 1, pipe 31 having nozzle 32. The introduction of fresh air during the second stage of the grinding process effectively doubles the cooling capacity obtained heretofore in conventional cement grinding processes.

It will be understood that a number of modifications may be incorporated of the device described hereinabove according to the method and apparatus of the invention. For example, the casing 4 of the above-described device surrounding a portion of the mill shell 1 can be equipped with other means for removing material. Also, the inlet for fresh air can be equipped with means for feeding material into the second section of the mill or material or grinding bodies may be passed backwards from the second section of the mill.

I claim:

1. A multi-compartment tube mill for grinding coarse material which comprises:

(a) a first mill section including at least one grinding chamber;

(b) a second mill section positioned adjacent the first mill section and including at least one grinding chamber;

(c) inlet means communicating with said first mill section for feeding coarse material to be ground and at least one of ventilating gas and air thereto;

(d) outlet means communicating with said second mill section of the tube mill for discharging ground material from the mill; and (e) a composite diaphragm disposed between said first and second mill sections and defining a heat exchange zone, said composite diaphragm having at least a first peripheral portion which defines at least one opening for the discharge of waste gas from said first mill section and at least a second peripheral portion which defines at least a second opening for directing gas to said second mill section of the tube mill, and at least one conduit to transfer material from said first mill section to said second mill section.

2. The tube according to claim 1 wherein at least one of said conduits has a generally spiral configuration.

3. The tube mill according to claim 1 wherein at least one of said conduits has a generally helical configuration.

4. The tube mill according to claim 3 wherein said conduit has a generally helical configuration and is positioned off the axis of rotation so as to facilitate the transfer of material through at least a portion of said composite diaphragm during rotation of the tube mill.

5. The tube mill according to claim 4 wherein said conduit is generally helically configured and spaced from the axis of rotation so as to continuously retain an amount of material sufficient to function substantially as an airtight sluice during rotation of the tube mill.

6. The tube mill according to claim 1 wherein said composite diaphragm comprises at least three generally cylindrical chambers.

7. The tube mill according to claim 6 wherein at least two of said cylindrical chambers are contiguous.

8. The tube mill according to claim 7 which further comprises a casing positioned about said composite diaphragm and configured to surround at least a portion of the tube mill.

9. The tube mill according to claim 8 wherein said casing is a generally annularly configured member having outlet means communicating with each opening of said first peripheral portion of said composite diaphragm for the discharge of waste gas from said first mill section, and inlet means communicating with each second opening of said second peripheral portion of said composite diaphragm to direct fresh gas to said second mill section.

10. The tube mill according to claim 9 wherein said composite diaphragm further comprises a sieving diaphragm disposed at one end of said composite diaphragm adjacent said first mill section.

11. The tube mill according to claim 10 wherein said composite diaphragm further comprises a first annular damming means at the other end of said composite diaphragm disposed adjacent said second mill section.

12. The tube mill according to claim 11 wherein said first annular damming means comprises a screen.

13. The tube mill according to claim 12 wherein said composite diaphragm further comprises a second annular damming means which divides two of said chambers of said composite diaphragm.

14. The tube mill according to claim 13 wherein said composite diaphragm further comprises a substantially solid partition extending generally perpendicular to the axis of said mill sections for separating two of said chambers of said composite diaphragm.

15. The tube mill according to claim 14 wherein at least one of said chambers further comprises lifting means to transfer material through at least a portion of said composite diaphragm at least during rotation of the tube mill.

16. The tube mill according to claim 15 wherein said casing further comprises a substantially annular chamber which communicates with said inlet means of said casing.

17. The tube mill according to claim 16 wherein said casing is stationary.

18. The tube mill according to claim 17 which further comprises support means for mounting said stationary casing.

19. The tube mill according to claim 18 which further comprises bearing means mounted for rotation of said tube mill.

20. The tube mill according to claim 19 which further comprises means to direct a cooling liquid to at least one of said mill sections.

21. A multi-compartment tube mill for grinding coarse material, which comprises at least two adjacent mill sections, each section including at least one grinding chamber, inlet means communicating with said first mill section for introducing coarse material and at least one of ventilating air and gas for heat exchange with the material, a composite diaphragm disposed intermediate the two mill sections and defining a separation zone, said diaphragm having peripheral portions which define a first plurality of peripheral openings in the mill shell for the withdrawal of the air or gas from the first section of the mill, and a second plurality of peripheral openings positioned and adapted to permit fresh air or gas to be directed to said second section of the mill, said composite diaphragm further including separate generally helical passages for transferring the material from said first section of the mill to said second section.

22. A multi-compartment tube mill for grinding coarse material, which comprises at least two adjacent mill sections, each section including at least one grinding chamber, inlet means communicating with said first mill section for introducing coarse material and at least one of ventilating air and gas for heat exchange with the material, a stationary casing disposed intermediate the mill sections, a composite diaphragm positioned within said stationary casing and defining a separation zone, said diaphragm having peripheral portions which define a first plurality of peripheral openings in the mill shell for the withdrawal of the air or gas from the first section of the mill, and a second plurality of peripheral openings positioned and adapted to permit fresh air or gas to be directed to said second section of the mill, a sieve drum positioned generally centrally of said composite diaphragm, said sieve drum defining at least one opening facing toward the first section of the mill so that at least partially ground material transferred from said first mill section to said sieve drum is sieved and finer particles having a predetermined size are transferred to and accumulated in said stationary casing, said composite diaphragm further including separate generally helical passages for transferring the material from said stationary casing to said second section.

23. A method of grinding coarse material such as cement clinker by means of a multi-compartment tube mill being divided into at least two mill grinding sections including a first mill section having at least one grinding chamber, a second mill section adjacent to the first mill section having at least one grinding chamber, inlet means communicating with said first mill section for introducing coarse material to be ground and at least one of ventilating air or gas to the mill, outlet means communicating with said second mill section for discharging the ground material, a composite diaphragm disposed intermediate said first and second mill sections and defining a separation zone therebetween, at least one conduit for transferring material from said first mill section to said second mill section comprising:

(a) directing coarse material to be ground and at least one of the ventilating gas and air to said first mill section for removing humidity and for cooling to predetermined temperature conditions;
(b) at least partially grinding the material in said first mill section;
(c) directing said ventilating air or gas through said composite diaphragm out of said first mill section;
(d) transferring material from said first mill section to said second mill section through said at least one conduit;
(e) introducing fresh ventilating air or gas through said composite diaphragm into said second mill section so as to control the temperature and humidity conditions in said second mill section; and
(f) directing the ground material and ventilating air or gas from said second mill section.

24. A method of grinding coarse material such as cement clinker by means of a multi-compartment tube mill being divided into at least two mill grinding sections including a first mill section having at least one grinding chamber, a second mill section adjacent the first mill section having at least one grinding chamber, inlet means communicating with said first mill section for introducing coarse material to be ground and at least one of ventilating air or gas to the mill, outlet means communicating with said second mill section for discharging the ground material, a composite diaphragm disposed intermediate said first and second mill sections and defining a separation zone therebetween, a casing surrounding said composite diaphragm, a plurality of conduits for transferring material from said first mill section to said second mill section comprising:

(a) directing coarse material to be ground and at least one of ventilating gas and air to said first mill section for removing humidity and for cooling to predetermined temperature conditions;
(b) at least partially grinding the material in said first mill section;
(c) directing said ventilating air or gas through said composite diaphragm out of said first mill section;
(d) transferring at least partially ground material from said first mill section to said second mill section through said casing and said plurality of conduits;
(e) introducing fresh ventilating air or gas through said composite diaphragm into said second mill section so as to control the temperature and humidity conditions in said second mill section; and
(f) directing the ground material and ventilating air or gas from said second mill section.

* * * * *